United States Patent [19]

Winfrey

[11] 4,285,255

[45] Aug. 25, 1981

[54] SAFETY SCREWDRIVER

[76] Inventor: Carl T. Winfrey, 115 Harmony St., Winston-Salem, N.C. 27105

[21] Appl. No.: 116,286

[22] Filed: Jan. 28, 1980

[51] Int. Cl.[3] ..... B25B 15/00

[52] U.S. Cl. ..... 81/451

[58] Field of Search ..... 145/30 A, 50 R; 81/451

[56] References Cited

U.S. PATENT DOCUMENTS

| | | | |
|---|---|---|---|
| 29,760 | 8/1860 | Boeklen | 145/30 A |
| 3,178,971 | 4/1965 | Bachli et al. | 145/50 D |
| 4,130,152 | 12/1978 | Bolen | 145/50 A |

*Primary Examiner*—Stephen G. Kunin
*Assistant Examiner*—J. T. Zatarga
*Attorney, Agent, or Firm*—Charles R. Rhodes; Judith G. Smith

[57] ABSTRACT

A safety screwdriver having a handle and a shank portion which includes an axially extending tubular extension surrounding a substantially rectangular blade recessed within. In the preferred embodiment the blade and tubular extension are a unitary construction with opposite side edges of the blade integrally cast to the side walls of the tube.

3 Claims, 2 Drawing Figures

SAFETY SCREWDRIVER

BACKGROUND AND SUMMARY OF THE INVENTION

Many attempts have been made to provide a hand operated screwdriver having a safety or guiding attachment utilized to inhibit lateral movement between the screwdriver and the screw, and to guide the blade of the screwdriver into alignment with the slot in the screw head. The prior art reveals various styles and forms of screwdriver shanks with attachments thereon which have the primary purposes of retaining the blade of the screwdriver shank in the head of the screw because lateral movement may cause injury to the operator or damage to adjacent work surfaces. Further it is desirable to retain the head of the screw within the screwdriver during placement of the screw, so that the shank of the screw may be more easily guided into places which are difficult to reach.

Examples of such prior art devices are illustrated in U.S. Pat. Nos. 1,782,448, 3,608,596, 2,756,791, 3,452,373, 3,517,714 and 723,694. Each of these patents reveals or discloses a safety screwdriver having separable attachments or multiple components designed to accomplish the above objectives. Problems inherent in these screwdrivers include the fact that they are quite expensive to produce because of the multiple components. Also, because of the multiple components there is an increased likelihood of failure or breaking of the tool during use or over a period of time. For example, U.S. Pat. No. 3,517,714 to Desbarats discloses a sleeve which is slidable along the screwdriver shank from an inoperable position wherein the screwdriver functions in a conventional manner, to an operative position over the blade which prevents the blade from slipping out of the slot in the head of the screw. Desbarats' movable sleeve is constructed of a flexible rubber material and is slipped downwardly over the blade as desired. However, because the sleeve is made of a flexible material it is likely to give under the pressure of driving a screw.

U.S. Pat. No. 3,556,184 to Wagner discloses a spring loaded device wherein the screwdriver blade is normally in a retracted position in the body, but during operation is pressed forward to engage the screwhead. However, in addition to being expensive to produce the spring-loaded apparatus may fail and permit the barrel to slip away from the screw head during operation injuring the operator or the work surface.

U.S. Pat. No. 3,608,596 to Yoho discloses a cylindrical tube including a blade extending axially therein with the terminal end of the blade being coplanar with the end of the cylindrical tube. Due to the separate construction of the blade and the cylindrical tube, if a great deal of pressure is applied to the blade in driving a screw it is quite likely that the blade will dislodge from the grooves inside the tube. Further, each time it becomes necessary to sharpen the blade, the blade will be shortened and difficult to fit within the tube without additional adjustments of the blade and/or tube.

In view of these devices and others similar thereto, applicant recognized a need for an improved safety screwdriver economically produced in a strengthened one-piece construction. The present invention is directed to such a device and includes a shank portion having a handle attached to one end and on the opposite end of the shank a hollow, axially aligned tubular extension. The terminal annular edge of the tubular extension lies in a plane transverse to the axis of the shank. An elongated flat blade is secured or integrally cast between the inner walls and base of the tubular extension. The short terminal edge of the blade is recessed inwardly a prescribed distance from the annular edge of the tube so that when the screwdriver is in use the head of the screw is concealed within the tubular extension with the blade engaged in the slot in the screw head.

In a preferred embodiment the shank portion and the tubular extension with the blade therein are cast or forged as one unit. Alternate procedures include welding or machining. This unitary construction increases the strength of the tool and decreases the cost of production. Additionally, because of the integral construction of the blade with the side walls of the cylinder there are no exposed or unsupported corners on the blade, thus significantly decreasing the necessity for sharpening. However, at any time the blade does require sharpening, the procedure may be carried out without removal of the blade from the cylinder by using an emery wheel.

It is therefore an object of the present invention to provide an improved safety screwdriver of the type having a cylindrical portion which sets over the screw head during driving to guard against lateral movement of the screwdriver.

A further object is to provide such an improved safety screwdriver having a one-piece construction which eliminates attachments or separable component parts.

Other objects and advantages will become apparent as the following detailed description is studied in conjunction with the attached drawings of which:

FIG. 1 is a perspective view of the present invention according to a preferred embodiment; and FIG. 2 is a detailed cross-sectional view of the head portion of the tool.

DETAILED DESCRIPTION OF A PREFERRED EMBODIMENT

Figure 1:
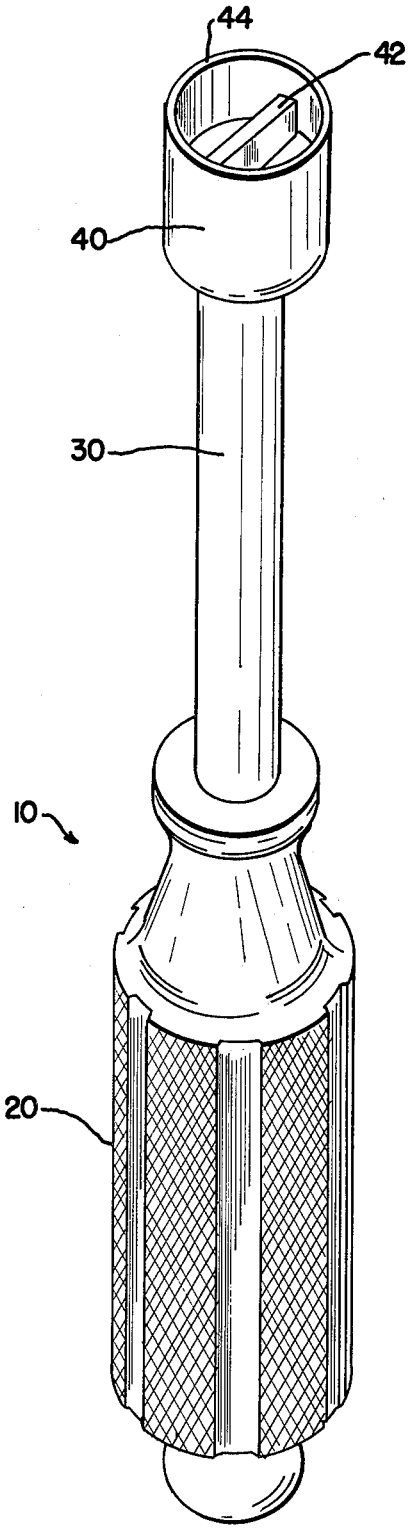

Looking first at FIG. 1, the screwdriver 10 according to a preferred embodiment includes a handle 20 and a shank portion 30. The shank 30 includes an enlarged tubular extension 40 at the end opposite handle 20. The tubular extension 40 includes within its confines a screw-engaging blade 42 which is recessed a prescribed distance inwardly from the annular edge 44 of the extension.

Figure 2:
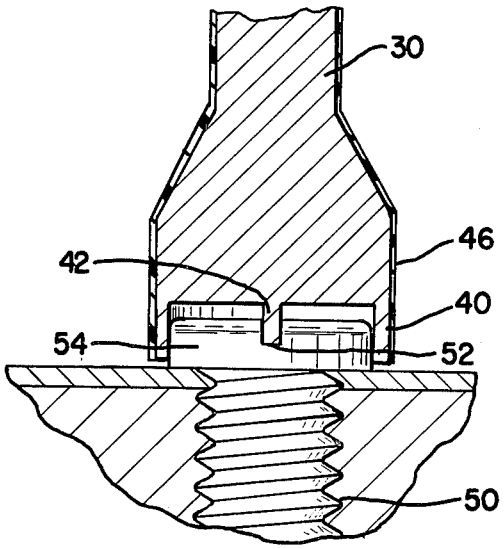

In use, the blade 42 as shown in FIG. 2 fits into the slot 52 of screw 50 while the tube 40 surrounds the screwhead 54. The vertical depth of the blade 42 is preferred to be a minimum of 3/16 of an inch in all sizes of screwdrivers. The recession of the blade 42 inwardly from the annular edge 44 varies according to the dimensions of the tubular extension. For example, if the inside diameter of the tubular extension is 5/16 of an inch, the blade would preferably have a thickness of 1/32 of an inch and would be recessed approximately 1/32 of an inch. If the inner diameter is 7/16 inch, the blade's thickness should be 1/16 of an inch and should be recessed 1/16 of an inch. These dimensions are merely exemplary as suitable for use with standard screws to ensure that the tubular member remains clear of the surface into which the screw is being inserted. It should be understood that the screwdrivers may be altered during tool production to accommodate screws of any size.

With regard to production of the tool, as stated hereinabove, the shank 30, the tubular extension 40 and the blade 42 are preferably cast or forged from steel as a unitary piece which significantly increases the strength as compared to the prior art devices previously discussed. Further, the unitary construction makes the tool more economical to produce. Looking again at FIG. 1, it is shown that the opposite, short side edges of the blade adjoin the inner surfaces of the tubular extension, leaving no unsupported corners of the blade to break off or wear away during use. If it should eventually become necessary to sharpen the blade 42 sharpening may be done with an emery wheel. However, due to the blade being formed integrally with the side walls of the tubular extension, and being cast or forged of steel or other durable metal, the blade corners and edges will be significantly strengthened and the necessity for sharpening lessened.

The shank 30 is fixed into a handle 20 which may be also cast, forged, or otherwise formed of metal or molded from a plastic or other such material. The handle has circumferentially spaced longitudinal grooves 22 along the surfaces thereof to improve the grip. If the handle is made from a non-conducting material such as plastic or rubber the screwdriver will be essentially electrically shockproof. A further aid to shockproofing is the optional addition of a heat-shrinkable plastic jacket 46 (FIG. 2) on the shaft and tubular extension.

In use the improved screwdriver can be used to hold the screw for insertion into inaccessible areas from approximately a 90° horizontal position of the screwdriver, to a vertical position having the tubular portion upward. Additionally, if used with a properly sized screw, the blade 42 is generally self-aligning within the screw slot with less than a 90° rotation of the screwdriver 10.

As previously mentioned the screwdriver may be made in a variety of sizes and is primarily designed for use with "pan-head" screws of the type used in electrical work. However, the screwdriver also may be modified for use with Phillips head or other types of screws. Other and further modifications may become apparent to those skilled in the art, but which modifications remain within the scope of the claims below.

What is claimed is:

1. The combination of a driver and slot head fastener comprising:

(a) a driver including an elongated shank portion having a handle secured to one end in axial alignment therewith and a hollow tubular extension in axial alignment thereto at the end opposite said handle;

(b) said slot head fastener having a threaded shank and a head of a prescribed thickness secured to one end of said shank, said head having a slot defined in the upper surface thereof, said slot extending a prescribed depth into and transversely of said head;

(c) said tubular extension of said driver including an elongated flat blade positioned therein such that the terminal edge of said blade is recessed a prescribed distance within said tubular extension;

(d) said prescribed distance of said blade recession being so related to the thickness of said fastener head and the depth of said slot that when said blade is positioned in said slot, said tubular member substantially encases said fastener head with the terminal edge of said tubular member positioned in a plane parallel to and intermediate of the upper and lower surfaces of said fastener head;

(e) whereby said tubular member remains clear of the surface into which said fastener is being inserted.

2. A screwdriver according to claim 1 wherein said shank, said tubular extension and said blade are formed in a unitary construction.

3. A screwdriver according to claim 1 wherein said handle is made from an electrically non-conducting material and said shank portion further includes a jacket therearound, said jacket being formed from an electrically non-conducting material.

* * * * *